US011540623B2

(12) United States Patent
Hung

(10) Patent No.: US 11,540,623 B2
(45) Date of Patent: Jan. 3, 2023

(54) SIDE TABLE

(71) Applicant: MODERNSOLID INDUSTRIAL CO., LTD., Taichung (TW)

(72) Inventor: Chin-Jui Hung, Taichung (TW)

(73) Assignee: MODERNSOLID INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/399,652

(22) Filed: Aug. 11, 2021

(65) Prior Publication Data

US 2022/0053925 A1 Feb. 24, 2022

(30) Foreign Application Priority Data

Aug. 19, 2020 (TW) ..... 109128231

(51) Int. Cl.
*A47B 9/10* (2006.01)
*A47B 9/20* (2006.01)

(52) U.S. Cl.
CPC . *A47B 9/10* (2013.01); *A47B 9/20* (2013.01)

(58) Field of Classification Search
CPC ..... A47B 9/10; A47B 9/20
See application file for complete search history.

(56) References Cited

U.S. PATENT DOCUMENTS 9,629,452 B1 * 4/2017 Chen ..... A47B 9/20
10,702,058 B1 * 7/2020 Wang ..... A47B 9/20
2012/0043436 A1 * 2/2012 Atkinson ..... A47B 9/20 248/188.5
2019/0174913 A1 * 6/2019 Lin ..... A47B 9/20
2019/0191866 A1 * 6/2019 Lin ..... A47B 9/04
2020/0305595 A1 * 10/2020 Lin ..... A47B 3/0815
2021/0227970 A1 * 7/2021 Randløv ..... B66C 23/707

FOREIGN PATENT DOCUMENTS

EP 3607855 A1 * 2/2020 ..... A47B 9/10
TW M572173 U 1/2019
WO WO-0205683 A1 * 1/2002 ..... A47B 13/023

OTHER PUBLICATIONS

Search Report appended to an Office Action, which was issued to Taiwanese counterpart application No. 109128231 by the TIPO dated Dec. 16, 2020, with an English translation thereof.

* cited by examiner

*Primary Examiner* — Daniel J Rohrhoff

(57) ABSTRACT

A side table includes a base unit, a top board, and a telescopic tube unit that is mounted to the base unit, and that includes an outer tube subunit, an inner tube subunit and a roller subunit. The outer tube subunit extends in an up-down direction. The inner tube subunit is coupled telescopically to the outer tube subunit. The roller subunit is mounted to the inner tube subunit, and includes a plurality of rollers that are in slidable contact with the outer tube subunit. The top board corresponds in position to the base unit in the up-down direction, and is mounted co-movably to the outer tube subunit such that a distance between the base unit and the top board in the up-down direction changes during telescopic operation of the telescopic tube unit.

7 Claims, 9 Drawing Sheets

SIDE TABLE

CROSS-REFERENCE TO RELATED APPLICATION

This application claims priority to Taiwanese Invention Patent Application No. 109128231, filed on Aug. 19, 2020.

FIELD

The disclosure relates to a side table, and more particularly to a side table with an adjustable height.

BACKGROUND

A conventional side table is commonly found near a bed, and may be used for putting things thereon or be used as a place at which a user may eat when in bed. The conventional side table has merits of being easily movable and space-efficient. In addition, the conventional side table includes an upright telescopic unit that includes an outer tube and an inner tube coupled telescopically to the outer tube. By virtue of the telescopic unit, the conventional side table is height-adjustable.

However, friction between the inner tube and the outer tube may be excessive so that telescopic operation of the telescopic unit may not be smoothly performed. Furthermore, the inner tube and the outer tube may not be fittingly coupled because of manufacturing tolerances of the inner and outer tubes. If the inner and outer tubes are loosely coupled together, it may cause the conventional side table to become more prone to wobble during use.

SUMMARY

Therefore, an object of the disclosure is to provide a side table that can alleviate at least one of the drawbacks of the prior art.

According to the disclosure, the side table includes a base unit, a telescopic tube unit and a top board. The base unit includes a bottom board that has a first end part and a second end part opposite to each other in a front-rear direction. The telescopic tube unit is mounted to the first end part of the bottom board of the base unit, and includes an outer tube subunit, an inner tune subunit and a roller subunit. The outer tube subunit extends in an up-down direction perpendicular to the front-rear direction, and has an outer surrounding surface, an inner surrounding surface and a tube space. The inner surrounding surface is surrounded by the outer surrounding surface. The tube space is defined by the inner surrounding surface. The inner tube subunit is coupled telescopically to the outer tube subunit, and extends in the up-down direction into the tube space. The roller subunit is mounted to the inner tube subunit, and includes a plurality of rollers being in slidable contact with the inner surrounding surface of the outer tube subunit. The top board corresponds in position to the base unit in the up-down direction, and is mounted co-movably to the outer tube subunit such that a distance between the base unit and the top board in the up-down direction changes during telescopic operation of the telescopic tube unit.

BRIEF DESCRIPTION OF TRE DRAWINGS

Other features and advantages of the disclosure will become apparent in the following detailed description of the embodiment with reference to the accompanying drawings, of which:

Figure 7:
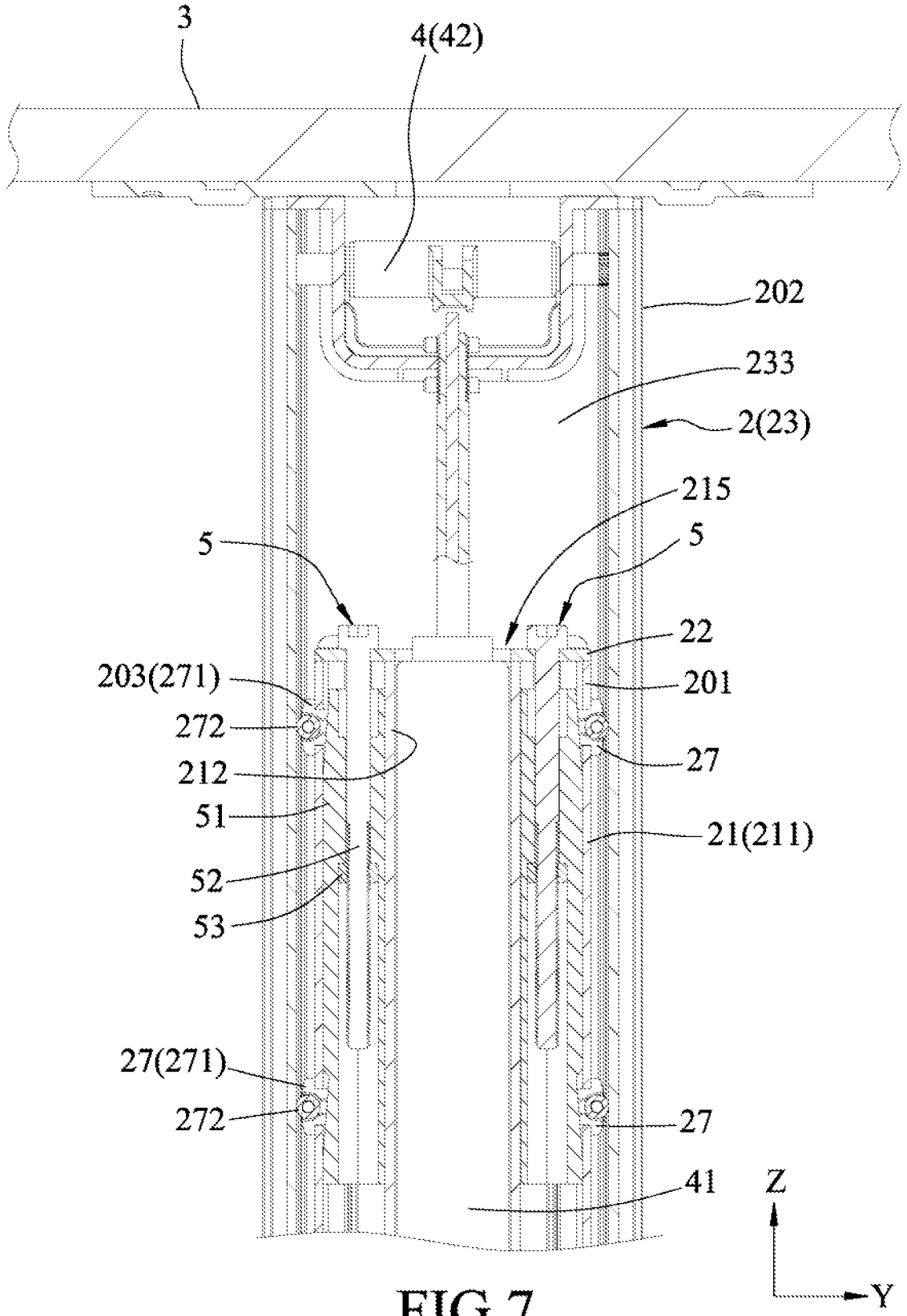
FIG. 7 is a fragmentary sectional view taken along line VII-VII in FIG. 2.
Figure 8:
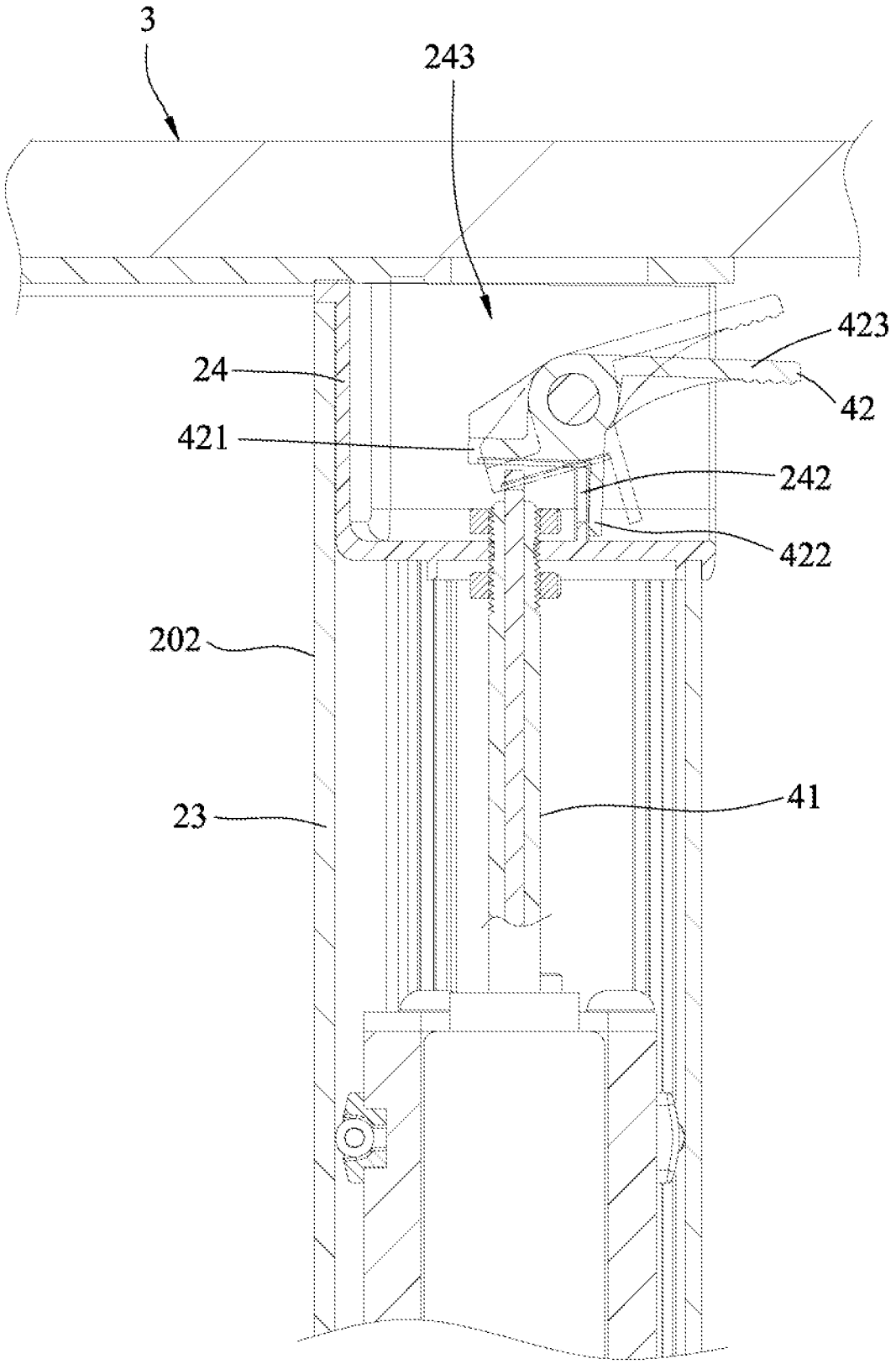
Figure 9:
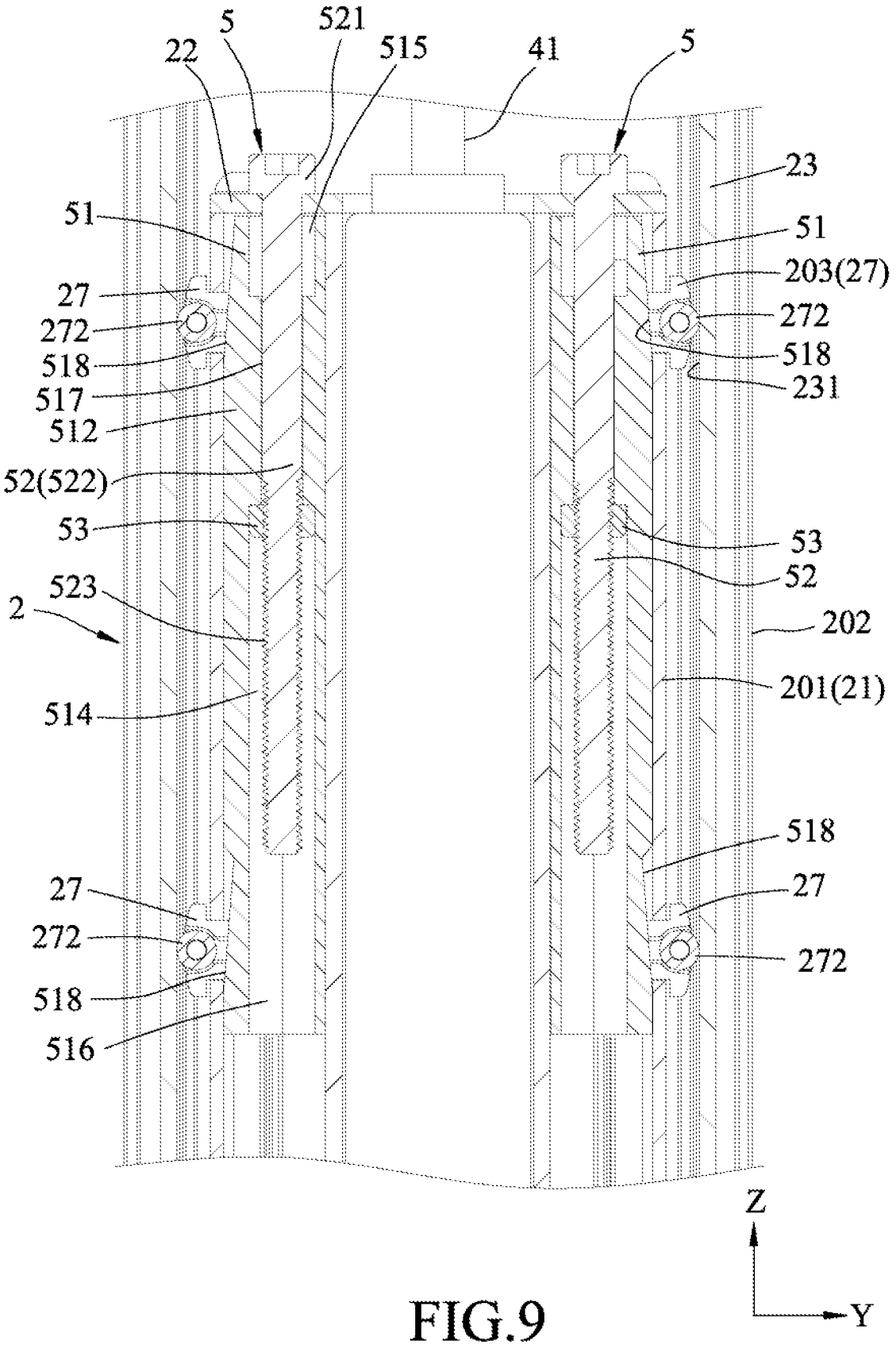

FIG. 8 is a fragmentary sectional view illustrating an actuating member of the embodiment being rotatable relative to a top seat of the embodiment between a free position (solid lines) and an abutting position (phantom lines); and FIG. 9 is a fragmentary sectional view similar to FIG. 7, with rollers of the adjusting roller members being pushed away from the inner tube by movement of adjusting seats of the adjusting unit in an up-down direction.

DETAILED DESCRIPTION

Referring to FIGS. 1 to 5, an embodiment of a side table according to the disclosure includes a base unit 1, a telescopic tube unit 2, a top board 3, a lifting unit 4 and two adjusting units 5. The side table is adapted to be used beside a bed (not shown).

The base unit 1 includes a bottom board 11, and a plurality of wheels 12 that are mounted under the bottom board 11 to impart higher mobility to the side table. The bottom board 11 has a first end part 111 and a second end part 112 opposite to each other in a front-rear direction X). The second end part 112 of the bottom board 11 may be adapted to be under the bed when the side table is in use. It is noted that in certain embodiments, the wheels 12 may be omitted.

The telescopic unit 2 is mounted to the first end part 111 of the bottom board 11 of the base unit 1 and includes an outer tube subunit 202, an inner tube subunit 201 and a roller subunit 203. Specifically, the inner tube subunit 201 is mounted to the first end part 111. The outer tube subunit 202 extends in an up-down direction (Z) perpendicular to the front-rear direction (X), and includes an outer tube 23. The outer tube 23 has an outer surrounding surface 232, an inner surrounding surface 231 that is surrounded by the outer surrounding surface 232, and a tube space 233 defined by the inner surrounding surface 231. The inner tube subunit 201 is coupled telescopically to the outer tube subunit 202 and extends in the up-down direction (Z) into the tube space 233. The roller subunit 203 is mounted to the inner tube subunit 201, and includes a plurality of rollers 272 being in slidable contact with the inner surrounding surface 231 of the outer tube subunit 202. By virtue of the rollers 272, friction between the outer tube subunit 202 and the inner tube subunit 201 is reduced so that the outer tube subunit 202 may smoothly move relative to the inner tube subunit 201 in the up-down direction (Z) during telescopic operation of the telescopic tube unit 2.

The top board 3 corresponds in position to the bottom board 11 of the base unit 1 in the up-down direction (Z), and is mounted co-movably to the outer tube subunit 202 such that a distance between the base unit 1 and the top board 3 in the up-down direction (Z) changes during the telescopic operation of the telescopic tube unit 2. Specifically, the top board 3 includes a securing member 31 and a table top body 32. The securing member 31 is secured on a top end of the outer tube subunit 202, and the table top body 32 is secured on the securing member 31 and serves as a table top.

The inner tube subunit 201 of the telescopic tube unit 2 includes an inner tube 21 and a securing plate 22 secured on a top end of the inner tube 21. The inner tube 21 extends in the up-down direction (2), and has an outer tube wall 211 and an inner tube wall 212. The outer tube wall 211 defines a containing space 213 in which the inner tube wall 212 is located, and is formed with a plurality of tube openings 214 communicating with the containing space 213. The inner tube wall 212 defines a channel 215. The securing plate 22 is formed with a channel opening 221 communicating with the channel 215, and covers a top end of the containing space 213 between the inner tube wall 212 and the outer tube wall 211.

The outer tube subunit 202 of the telescopic tube unit 2 further includes a top seat 24 and a base seat 25 respectively mounted to a top end and a bottom end of the outer tube 23. The top board 3 is secured on the top seat 24 via the securing member 31 thereof. The top seat 24 has a seat body 241 and a movement-restraining section 242 formed at the seat body 241. Specifically, a portion of the seat body 241 is inserted into the tube space 233 of the outer tube 23 and is formed with a groove 243. The movement-restraining section 242 is disposed in the groove 243.

The roller subunit 203 of the telescopic tube unit 2 further includes at least one pair of adjusting roller members 27 and a pair of stationary roller members 28. In certain embodiments, the roller subunit 203 may include a plurality of pairs of the adjusting roller members 27. In this embodiment, the roller subunit 203 includes four pairs of the adjusting roller members 27. For each of the pairs of the adjusting roller members 27, the adjusting roller members 27 are spaced apart from each other in the up-down direction (Z) and are mounted respectively to corresponding ones of the tube openings 214 of the inner tube 21 of the inner tube subunit 201. The pair of the stationary roller members 28 are spaced apart from each other in the up-down direction (Z) and are mounted respectively to corresponding ones of the tube openings 214. Two pairs of the adjusting roller members 27 are arranged perpendicularly to the other two pairs of the adjusting roller members 27, and are arranged to be spaced apart from the pair of the stationary roller members 28 in the front-rear direction (X). The other two pairs of the adjusting roller members 27 are spaced apart from each other in a left-right direction (Y) perpendicular to the up-down direction (Z) and the front-rear direction (X). Specifically, the two pairs of the adjusting roller members 27 are located at a rear side of the inner tube subunit 201, the pair of the stationary roller members 28 are located at a front side of the inner tube subunit 201, and the other two pairs of the adjusting roller members 27 are respectively located at a left side and a right side of the inner tube subunit 201. It is noted that the numbers of the adjusting roller member 27 and the stationary roller member 28, and the locations at which the adjusting roller member 27 and the stationary roller member 28 are located are not limited to those disclosed in the Figures and mentioned above, and may vary according to operational requirements.

Figure 1:
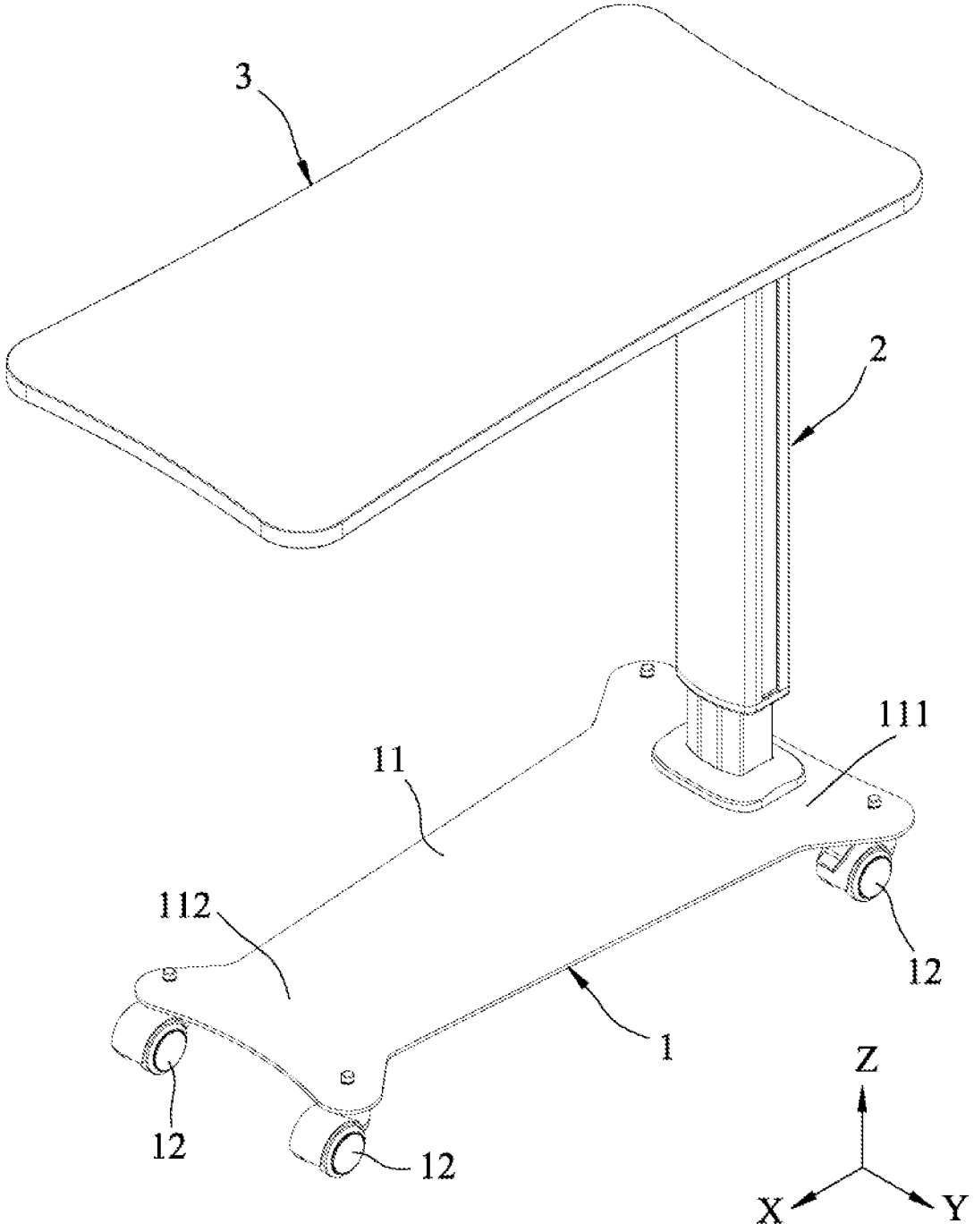
FIG. 1 is a perspective view of an embodiment, of a side table according to the disclosure.
Figure 2:
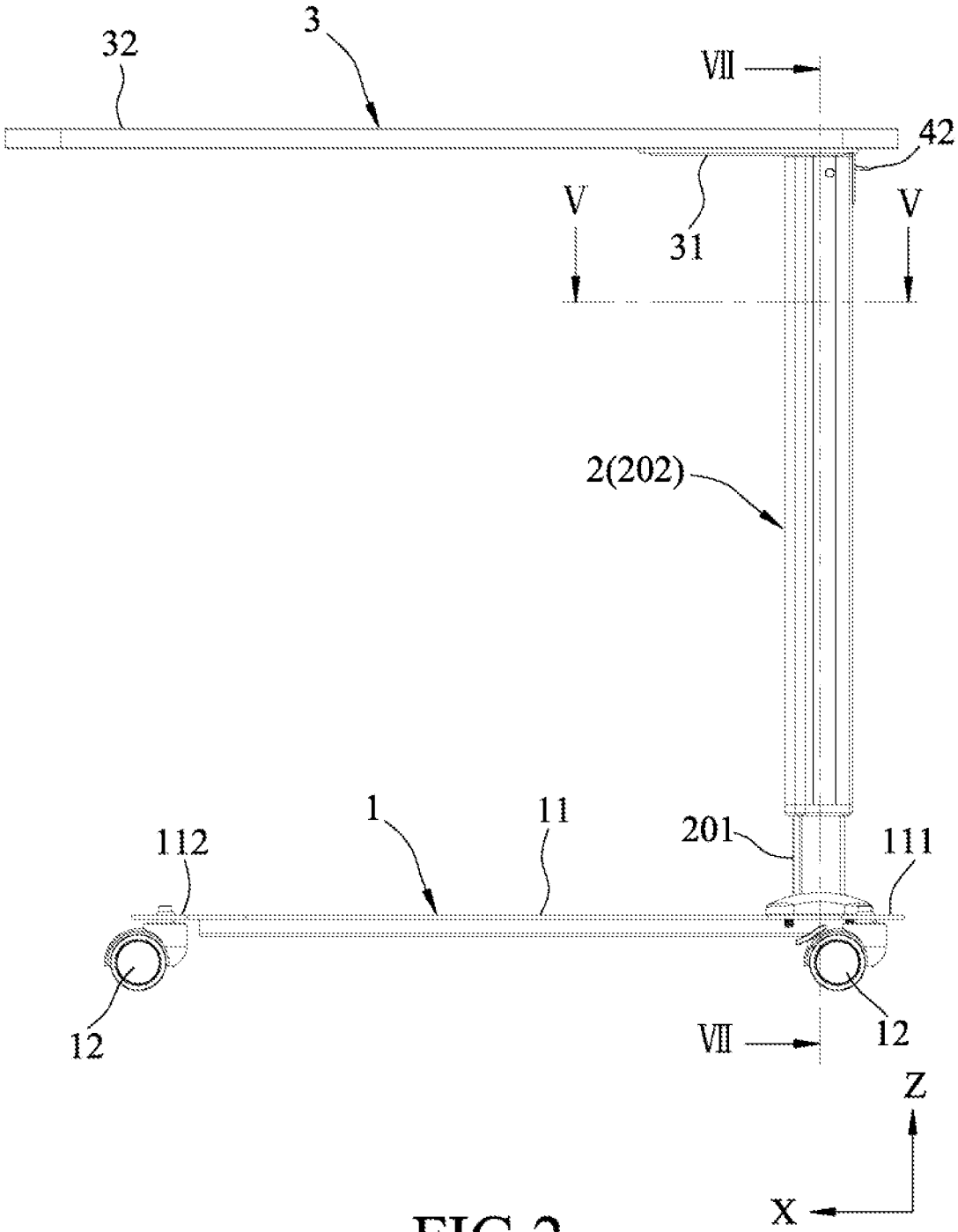
FIG. 2 is a side view of the embodiment.
Figure 3:
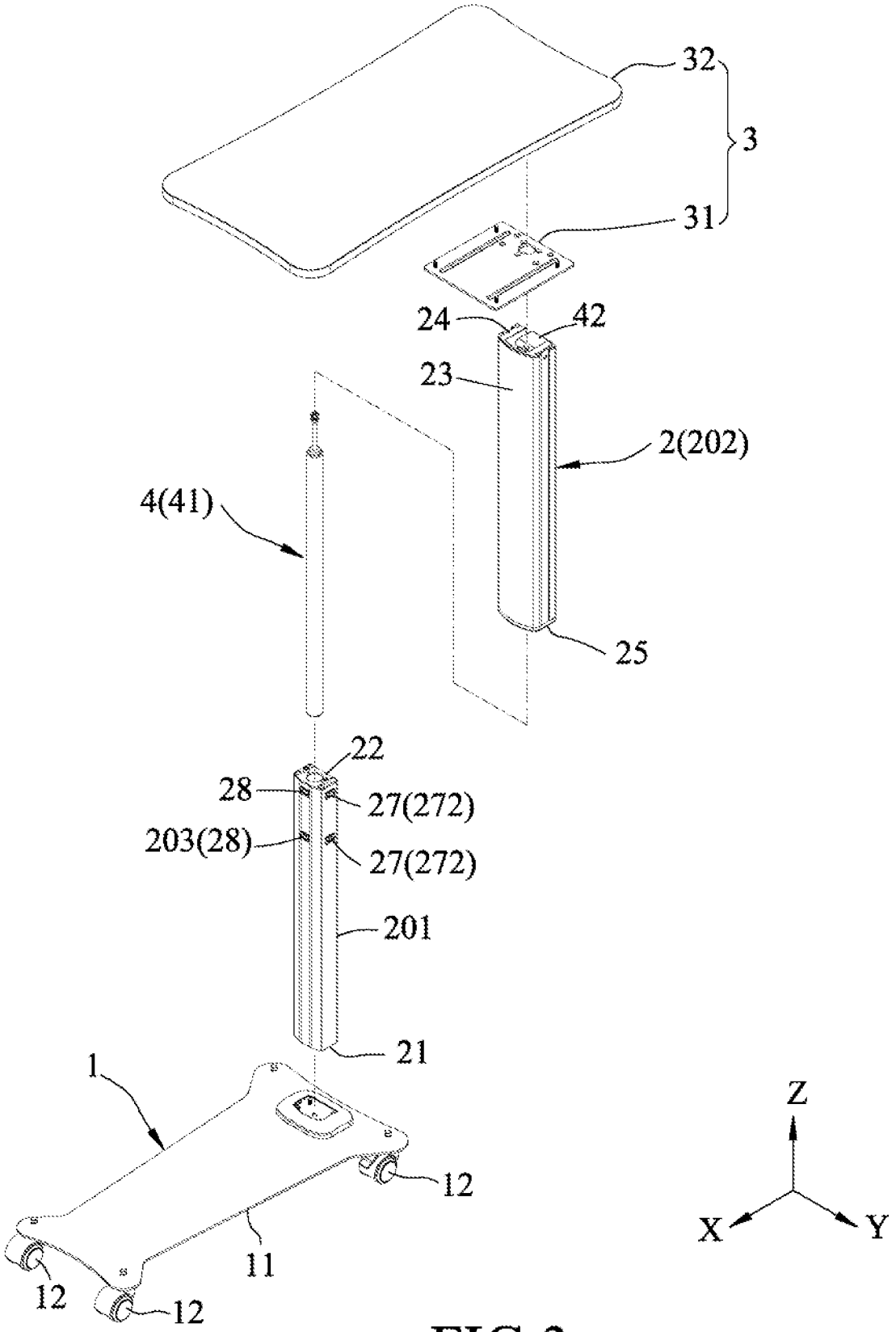
FIG. 3 is a partly exploded perspective view of the embodiment.
Figure 4:
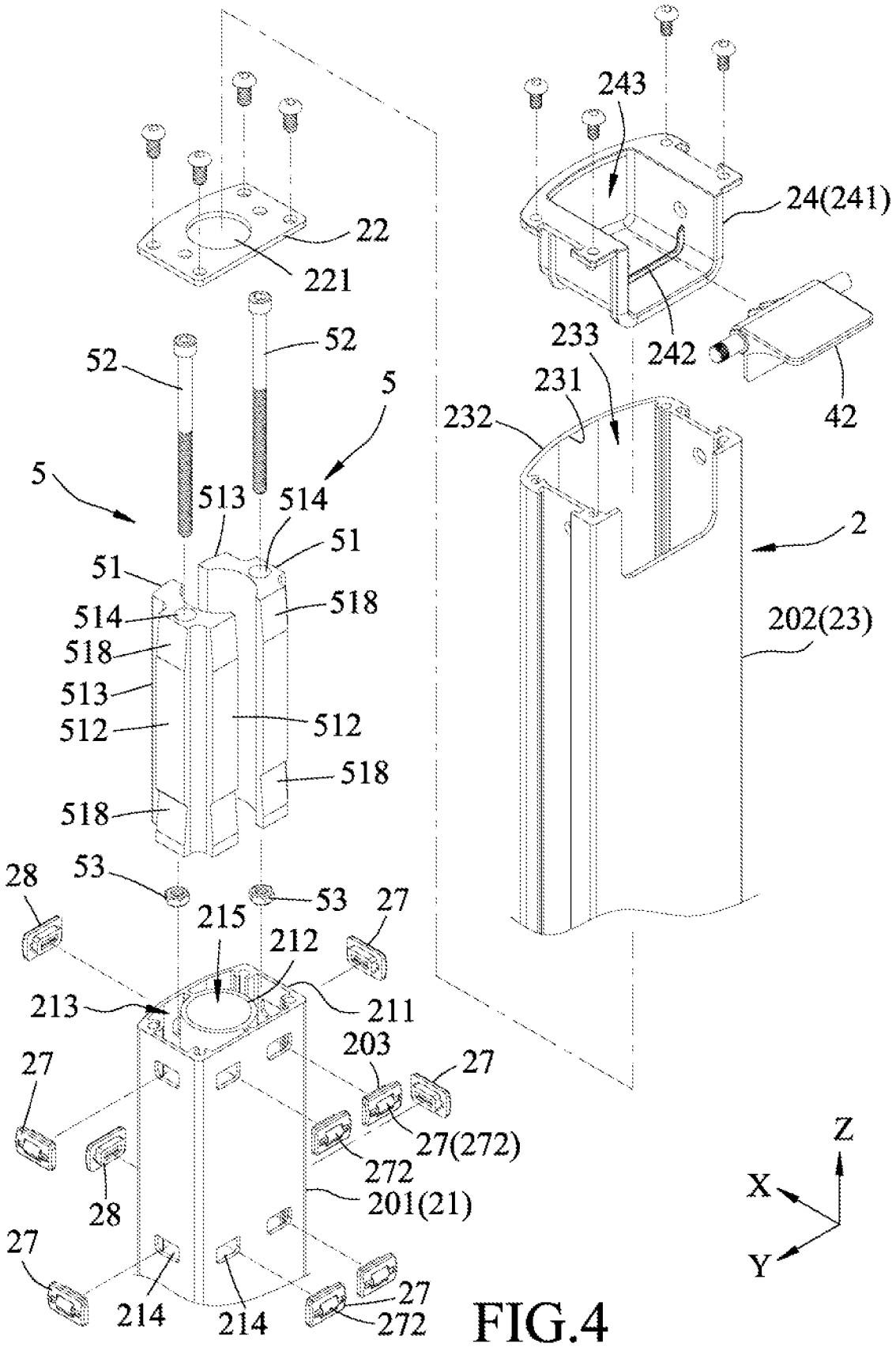
FIG. 4 is a fragmentary, partly exploded perspective view of a telescopic tube unit and an adjusting unit of the embodiment.
Figure 5:
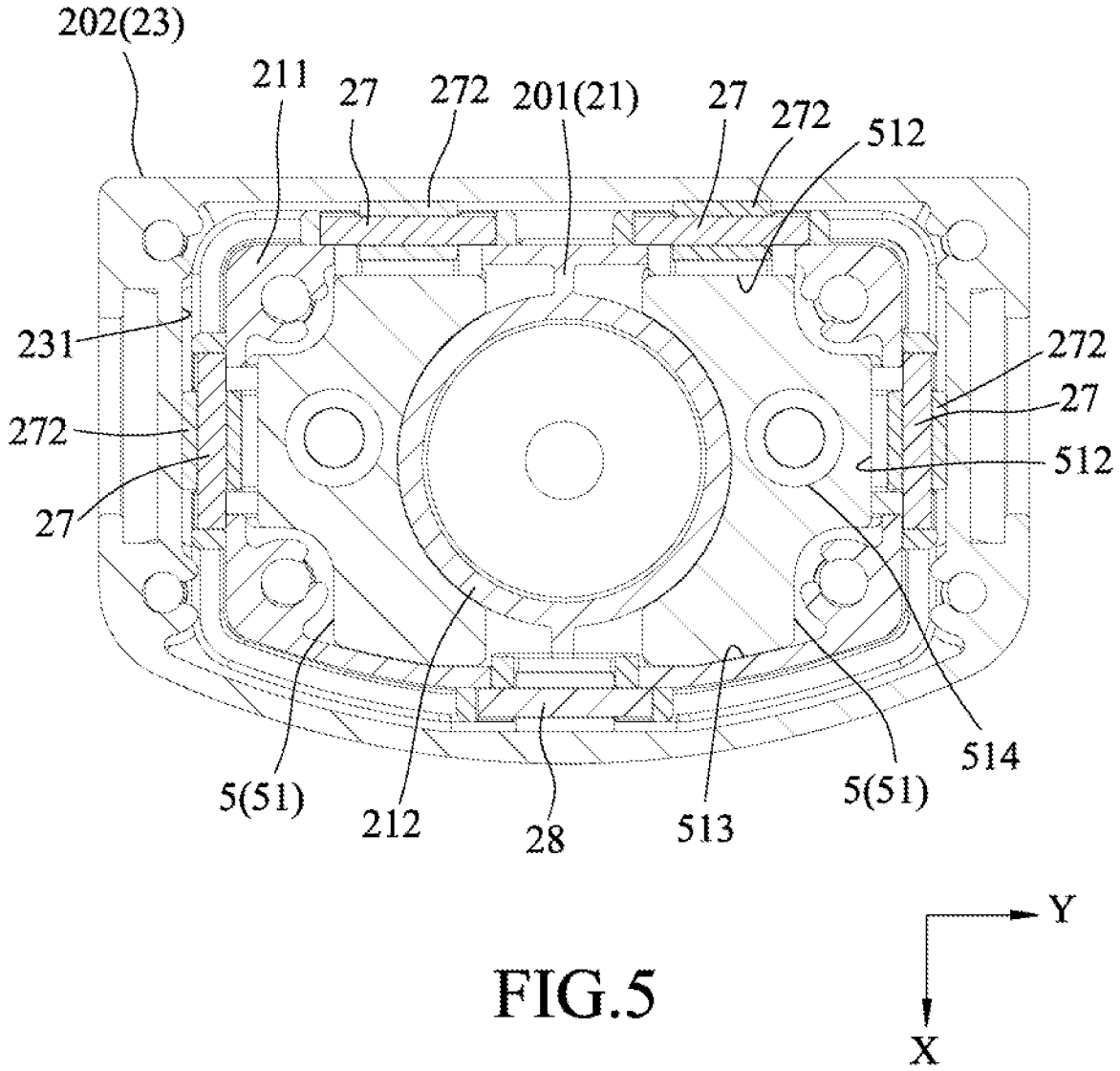
FIG. 5 is a sectional view of the telescopic tube unit taken along line V-V in FIG. 2.
Figure 6:
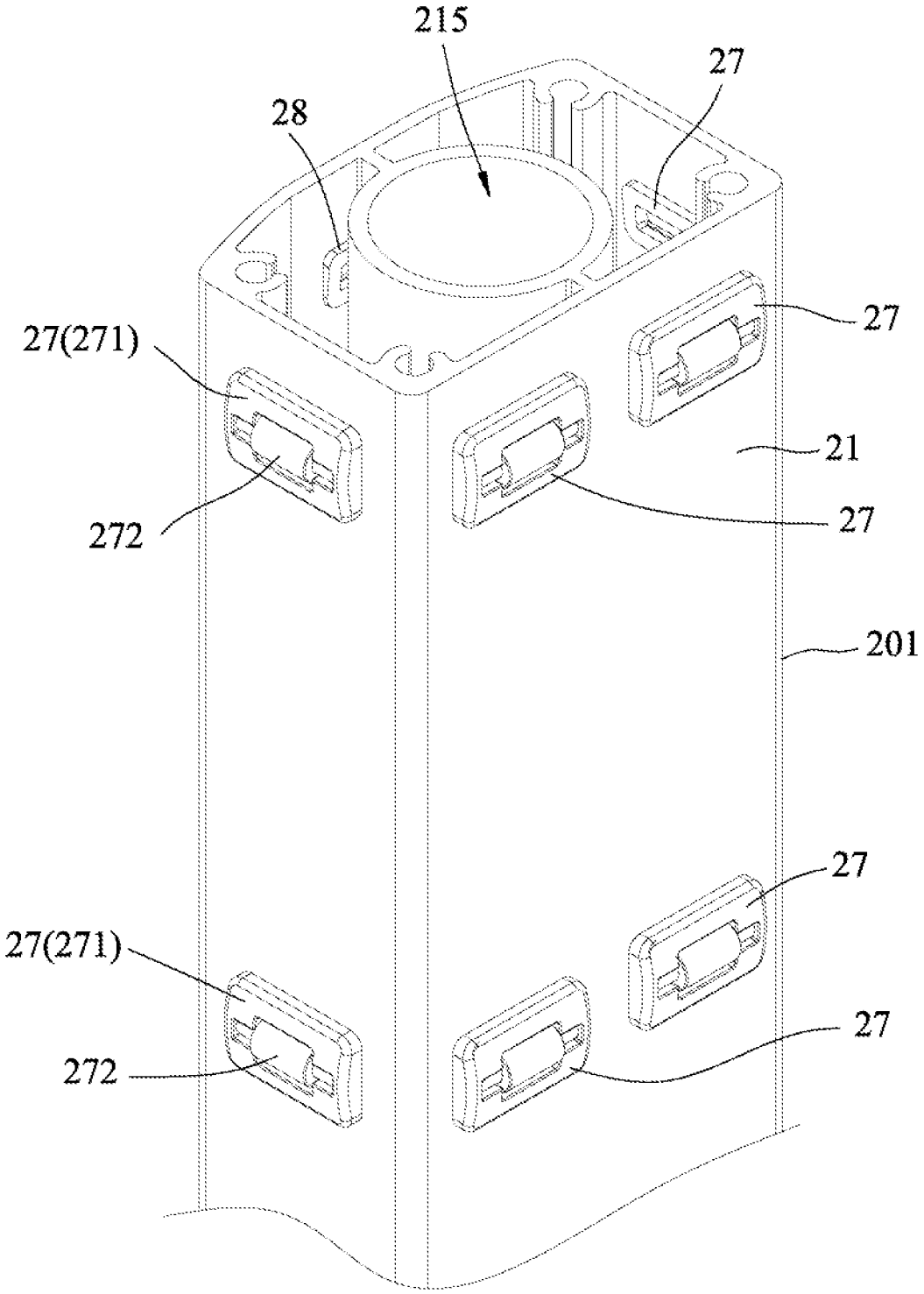
FIG. 6 is a fragmentary perspective view of an inner tube and adjusting roller members of the telescopic tube unit.

Referring further to FIG. 6, each of the adjusting roller members 27 includes a mounting seat 271 that is mounted to the inner tube 21 of the inner tube subunit 201, and one of the abovementioned rollers 272 that is rotatably mounted to the mounting seat 271. Each of the stationary roller members 28 has a structure that is the same as that of each of the adjusting roller members 27, and is in slidable contact with the inner surrounding surface 231 of the outer tube 23 through a roller thereof.

Referring to FIG. 7, the lifting unit 4 includes a pneumatic rod 41 and an actuating member 42. The pneumatic rod 41 is connected between the inner tube subunit 201 and the outer tube subunit 202 of the telescopic tube unit 2, and extends into the channel 215 of the inner tube 21 of the inner tube subunit 201. The actuating member 42 is operable for actuating operation of the pneumatic rod 41 to extend and retract, thereby driving the telescopic operation of the telescopic tube unit 2. It is noted that, in this embodiment, the height of the side table has stepless adjustability by virtue of the pneumatic rod 41. However, in certain embodiments, the configuration of the lifting unit 4 may vary. For example, the lifting unit 4 may be a threaded rod movably engaging a threaded hole, such that rotation of the threaded rod simultaneously drives linear movement of the threaded rod to thereby achieve a stepless adjustment of the height of the side table. Alternatively, the lifting unit 4 may be a rod that is linearly movable and that can be arrested from moving via a regular pin-hole engagement to thereby secure the height of the side table at various specific heights.

Referring further to FIG. 8, the actuating member 42 of the lifting unit 4 is mounted in the groove 243 of the top seat 24 of the outer tube subunit 202, and is rotatable relative to the top seat 24 between a free position (as illustrated by solid lines in FIG. 8) and an abutting position (as illustrated by phantom lines in FIG. 8). The actuating member 42 has a first abutting section 422 and an actuating abutting section 423 that cooperatively form an L-shaped structure, and a second abutting section 421 that protrudes from an intersection of the first abutting section 422 and the actuating section 423. The actuating section 423 of the actuating member 42 extends out from the top seat 24. The actuating section 423 of the actuating member 42 is operable (e.g., by a pulling or a pressing action) for actuating the rotation of the actuating member 42. At the free position, by virtue of the first abutting section 422 thereof abutting against the movement-restraining section 242 of the top seat 24, the actuating member 42 is separated from the pneumatic rod 41. At the abutting position, the first abutting section 422 of the actuating member 42 is separated from the movement-restraining section 242 of the top seat 24, and the second abutting section 421 of the actuating member 42 abuts against a top end of the pneumatic rod 41 to actuate the operation of the pneumatic rod 41 to extend and retract.

The adjusting units 5 are spaced apart from each other in the left-right direction (Y) and are disposed respectively at opposite sides of the pneumatic rod 41 of the lifting unit 4. Each of the adjusting units 5 includes an adjusting seat 51, an adjusting rod 52 and a threaded connecting member 53. The adjusting seat 51 is surrounded by the outer tube wall 211 of the inner tube 21 of the inner tube subunit 201, is in contact with the inner tube wall 212 of the inner tube 21, is movable relative to the inner tube subunit 201, and has at least one inclined surface 518 that is inclined in the up-down direction (Z) and that abuts against the roller subunit 203 of the telescopic tube unit 2. The adjusting rod 52 is rotatably disposed in the inner tube subunit 201 and extends in the up-down direction (Z) into the adjusting seat 51. The threaded connecting member 53 is mounted to the adjusting seat 51 and is threadedly connected to the adjusting rod 52 such that rotation of the adjusting rod 52 relative to the threaded connecting member 53 drives movement of the threaded connecting member 53 along the adjusting rod 52.

Specifically, for each of the adjusting units 5, the adjusting seat 51 has two roller-pushing parts 512 (see FIG. 4), an extending part 513 and a through hole 514. The roller-pushing parts 512 and the extending part 513 are integrally formed. The roller-pushing parts 512 are substantially perpendicular to each other. Each of the roller-pushing parts 512 is formed with two inclined surfaces 518 (i.e., each adjusting unit 5 has four inclined surfaces 518). Specifically, the roller-pushing parts 512 of each of the adjusting units 5 correspond in position to two pairs of the adjusting roller members 27 of the roller subunit 203, respectively. Additional detailed information of the roller-pushing parts 512 will be given later in the description. The through hole 514 is located among the extending part 513 and the roller-pushing parts 512, and extends in the up-down direction (Z). Referring further to FIG. 9, the through hole 514 has a first hole section 515, a second hole section 516 and an interconnecting section 517. The first hole section 515 and the second hole section 516 are located respectively at a top end and a bottom end of the adjusting seat 51. The interconnecting section 517 interconnects the first hole section 515 and the second hole section 516. A diameter of the interconnecting section 517 is smaller than that of the second hole section 516, and is smaller than that of the first hole section 515 as well. The adjusting seat 51 further has an internal hole-defining surface that defines the first and second hole sections 515, 516 and the interconnecting section 517. The internal hole-defining surface has a stepped shoulder part at a junction of the interconnecting section 517 and the second hole section 516. The threaded connecting member 53 is located at the second hole section 516 and abuts against the stepped shoulder part of the internal hole-defining surface.

The adjusting rod 52 of each of the adjusting units 5 has a head part 521, a threaded part 523, and a rod body part 522 interconnecting the head part 521 and the threaded part 523. The head part 521 abuts against a top surface of the securing plate 22 of the telescopic tube unit 2. The rod body part 522 extends from the head part 521 into the through hole 514. The threaded part 523 extends from a bottom end of the rod body part 522 into the second hole section 516 of the through hole 514. For each adjusting unit 5, the threaded connecting member 53 is threadedly connected to the threaded part 523 of the adjusting rod 52. A user may turn the head part 521 of the adjusting rod 52 to drive the abovementioned rotation of the adjusting rod 52.

The following is the additional detailed information of the roller-pushing parts 512. The inclined surfaces 518 of each of the roller-pushing parts 512 are spaced apart from each other in the up-down direction (Z) and respectively correspond in position to the respective one pair of the adjusting roller members 27 of the roller subunit 203. Each of the inclined surfaces 518 movably abuts against the mounting seat 271 of the respective one of the adjusting roller members 27, and has a top end and a bottom end that are respectively distal from and proximate to the outer tube wall 211 of the inner tube 21.

For each adjusting unit 5, the adjusting seat 51 is comovable with the threaded connecting member 53 relative to the adjusting rod 52 in the up-down direction (Z), such that movement of the adjusting seat 51 in the up-down direction (Z) relative to the inner tube subunit 201 keeps the rollers 272 of the respective two pairs of the adjusting roller members 27, via the corresponding inclined surfaces 518 of the adjusting seat 51, staying in slidable contact with the inner surrounding surface 231 of the outer tube subunit 202.

Therefore, during assembly process of the side table, when the inner tube 21 and the outer tube 23 are loosely coupled together and a gap between the outer tube wall 211 of the inner tube 21 and the inner surrounding surface 231 of the outer tube 23 is relatively great, the head parts 521 of the adjusting rods 52 may be turned to drive the adjusting seats 51 to move upwardly so that the adjusting roller members 27 are pushed toward the inner surrounding surface 231 of the cuter tube 23 via the contact between the corresponding inclined surfaces 518 and the mounting seats 271. When the outer tube 23 is not large enough to be properly coupled to the inner tube 21, the head parts 521 of the adjusting rods 52 may be turned reversely to drive the adjusting seats 51 to move downwardly so that the adjusting roller members 27 can be pushed inwardly by the inner surrounding surface 231 of the outer tube 23 so that the outer tube 23 can be fittingly coupled to the inner tube 21. Consequently, manufacturing tolerance of the inner tube 21 and that of the outer tube 23 may not cause any problems for the assembly of the inner tube 21 and the outer tube 23, and the telescopic operation of the telescopic unit 2 may be well performed.

It is noted that, in certain embodiments, the side table may include only one adjusting unit 5, and the movement of the adjusting seat 51 of the adjusting unit 5 may nevertheless keep the rollers 272 of the adjusting roller members 27 staying in slidable contact with the inner surrounding surface 231 of the outer tube subunit 202 to achieve the same purpose.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A side table comprising:

a base unit including a bottom board that has a first end part and a second end part opposite to each other in a front-rear direction;

a telescopic tube unit mounted to said first end part of said bottom board of said base unit, and including an outer tube subunit that extends in an up-down direction perpendicular to the front-rear direction, and that has an outer surrounding surface, an inner surrounding surface surrounded by said outer surrounding surface, and a tube space defined by said inner surrounding surface, an inner tube subunit that is coupled telescopically to said outer tube subunit, and that extends in the up-down direction into said tube space, and a roller subunit that is mounted to said inner tube subunit, and that includes a plurality of rollers being in slidable contact with said inner surrounding surface of said outer tube subunit; and a top board corresponding in position to said base unit in the up-down direction, and mounted co-movably to said outer tube subunit such that a distance between said base unit and said top board in the up-down direction changes during telescopic operation of said telescopic unit;

wherein said side table further comprises a lifting unit that includes a pneumatic rod connected between said inner tube subunit and said outer tube subunit, and an actuating member that is operable for actuating operation of said pneumatic rod to extend and retract, thereby driving the telescopic operation of said telescopic tube unit;

wherein said outer tube subunit includes an outer tube having said outer surrounding surface and said inner surrounding surface, and a top seat mounted to a top end of said outer tube, said top board being secured on said top seat; and wherein said actuating member of said lifting unit is mounted to said top seat, and is rotatable relative to said top seat between a free position, where said actuating member is separated from said pneumatic rod, and an abutting position, where said actuating member abuts against said pneumatic rod to actuate the operation of said pneumatic rod to extend and retract.

2. A side table comprising:

a base unit including a bottom board that has a first end part and a second end part opposite to each other in a front-rear direction;

a telescopic tube unit mounted to said first end part of said bottom board of said base unit, and including an outer tube subunit that extends in an up-down direction perpendicular to the front-rear direction, and that has an outer surrounding surface, an inner surrounding surface surrounded by said outer surrounding surface, and a tube space defined by said inner surrounding surface, an inner tube subunit that is coupled telescopically to said outer tube subunit, and that extends in the up-down direction into said tube space, and a roller subunit that is mounted to said inner tube subunit, and that includes a plurality of rollers being in slidable contact with said inner surrounding surface of said outer tube subunit;

a top board corresponding in position to said base unit in the up-down direction, and mounted co-movably to said outer tube subunit such that a distance between said base unit and said top board in the up-down direction changes during telescopic operation of said telescopic unit; and at least one adjusting unit including an adjusting seat that is surrounded by said inner tube subunit, that is movable relative to said inner tube subunit, and that has at least one inclined surface inclined in the up-down direction, and abutting against said roller subunit, an adjusting rod that is rotatably disposed in said inner tube subunit and that extends in the up-down direction into said adjusting seat, and a threaded connecting member that is mounted to said adjusting seat and that is threadedly connected to said adjusting rod such that rotation of said adjusting rod relative to said threaded connecting member drives movement of said threaded connecting member along said adjusting rod, said adjusting seat being co-movable with said threaded connecting member relative to said adjusting rod in the up-down direction, such that movement of said adjusting seat in the up-down direction keeps said at least one of said rollers, via said inclined surface of said adjusting seat, staying in slidable contact with said inner surrounding surface of said outer tube subunit.

3. The side table as claimed in claim 2, wherein said roller subunit of said telescopic tube unit includes at least one pair of adjusting roller members that are spaced apart from each other in the up-down direction, each of said adjusting roller members including one of said rollers, said at least one inclined surface of said adjusting seat of said at least one adjusting unit including at least two inclined surfaces that are spaced apart from each other in the up-down direction and that respectively correspond in position to said at least one pair of said adjusting roller members.

4. The side table as claimed in claim 3, wherein:

said at least one adjusting unit includes two adjusting units that are spaced apart from each other in a left-right direction perpendicular to the front-rear direction and the up-down direction;

said roller subunit of said telescopic tube unit includes a pair of stationary roller members that are mounted to said inner tube subunit of said telescopic tube unit, that are spaced apart from each other in the up-down direction, and that are in slidable contact with said inner surrounding surface of said outer tube subunit; and said at least one pair of said adjusting roller members of said roller subunit includes two pairs of said adjusting roller members, one pair of said adjusting roller members being arranged perpendicularly to the other one pair of said adjusting roller members, and being arranged to be spaced apart from said pair of said stationary roller members in the front-rear direction.

5. The side table as claimed in claim 3, wherein:

said at least one adjusting unit include two adjusting units that are spaced apart from each other in a left-right direction perpendicular to the front-rear direction and the up-down direction;

said at least one pair of said adjusting roller members of said roller subunit of said telescopic tube unit includes two pairs of said adjusting roller members, said at least two inclined surfaces of said adjusting seat of each of said adjusting units respectively corresponding in position to a respective one pair of said adjusting roller members;

said side table further comprises a lifting unit that includes a pneumatic rod connected between said inner tube subunit and said outer tube subunit of said telescopic tube unit, and being operable to extend and retract, thereby driving the telescopic operation of said telescopic tube unit; and said adjusting units are disposed respectively at opposite sides of said lifting unit.

6. The side table as claimed in claim 2, wherein said adjusting seat of said at least one adjusting unit has a through hole extending therethrough in the up-down direction, said through hole having a first hole section and a second hole section that are located respectively at a top end and a bottom end of said adjusting seat, and an interconnecting section that interconnects said first hole section and said second hole section, a diameter of said interconnecting section being smaller than that of said second hole section, said adjusting seat further having an internal hole-defining surface that defines said first and second hole sections and said interconnecting section, said internal hole-defining surface having a stepped shoulder part at a junction of said interconnecting section and said second hole section, said threaded connecting member being located at said second hole section and abutting against said stepped shoulder part of said internal hole-defining surface.

7. The side table as claimed in claim 2, wherein:

said at least one inclined surface of said adjusting seat of said at least one adjusting unit includes a plurality of said inclined surfaces;

said roller subunit of said telescopic tube unit includes a plurality of adjusting roller members that respectively correspond in position to said inclined surfaces, each of said adjusting roller members including a mounting seat that is mounted to said inner tube subunit, and one of said rollers that is rotatably mounted to said mounting seat, each of said inclined surfaces movably abutting against said mounting seat of the respective one of said adjusting roller members.

* * * * *